United States Patent [19]

Skjerseth

[11] Patent Number: 4,686,910

[45] Date of Patent: Aug. 18, 1987

[54] ADJUSTABLE MULTI-LEAF TABLE

[75] Inventor: Douglas N. Skjerseth, Petaluma, Calif.

[73] Assignee: Seth Products, Inc., Santa Rosa, Calif.

[21] Appl. No.: 846,693

[22] Filed: Apr. 1, 1986

[51] Int. Cl.[4] ..... A47B 3/06

[52] U.S. Cl. ..... 108/153; 108/118; 108/65; 108/90

[58] Field of Search ..... 108/153, 154, 157, 116, 108/118, 61, 64, 65, 90, 67; 248/164, 431, 432

[56] References Cited

U.S. PATENT DOCUMENTS

| | | | |
|---|---|---|---|
| 139,925 | 6/1873 | Shaw | 248/431 X |
| 827,949 | 8/1906 | Wilkins | 108/118 X |
| 953,439 | 5/1910 | McGvigan | 108/157 X |
| 1,482,742 | 2/1924 | Gilchrist | 108/157 |
| 1,975,857 | 10/1934 | McKenney . | |
| 2,410,330 | 10/1946 | Ashenfelter | 108/153 X |
| 2,546,097 | 3/1951 | Hild | 108/116 X |
| 2,581,023 | 1/1952 | Jerick . | |
| 2,628,141 | 2/1953 | Scheuer | 108/157 |
| 2,872,259 | 2/1959 | Thorpe | 108/69 |
| 3,421,459 | 1/1969 | McGuigan | 108/157 X |
| 3,685,824 | 8/1972 | Quinn | 108/118 X |
| 4,168,669 | 9/1979 | Arnoff | 108/116 |
| 4,217,832 | 8/1980 | Pozzan | 108/64 X |
| 4,244,300 | 1/1981 | Leach | 108/116 |

*Primary Examiner*—Kenneth J. Dorner
*Assistant Examiner*—José V. Chen
*Attorney, Agent, or Firm*—Townsend and Townsend

[57] ABSTRACT

A work table is disclosed having three end-to-end abutted sections joined by adjustable longitudinal bars for forming a rigid table from one or more of the respective sections. Four sets of adjustable bars extend longitudinally of the table and fit varying lengths of the table comprising from 1 to 3 sections of the abutted table members. The bars extend in parallel to the longitudinal length of the table, provide rigidity to the respective table sections as well as extend between the respective sections when one or more leaves are joined. Cross X-type legs are provided with a variable pivot. The variable pivots enables the crossover point of the legs to be varied so that the table may be disposed at various heights and inclinations about its longitudinal length. The legs are provided at their upper end with U-sectioned channels having locking wing nuts for keying at selected locations to the longitudinal bars. The legs at their lower end include parallel extending shoe members to impart a longitudinal rigidity as well as a side-by-side rigidity to the supported work surface of the table. The table when disassembled provides for convenient storage and shipment in a small contained package. Provision is made for the mounting of a quilting rack.

4 Claims, 10 Drawing Figures

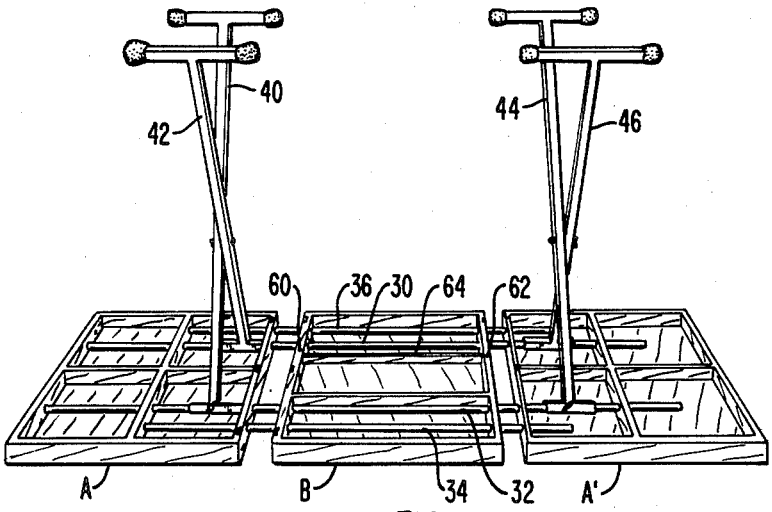
FIG._4.
FIG._5.
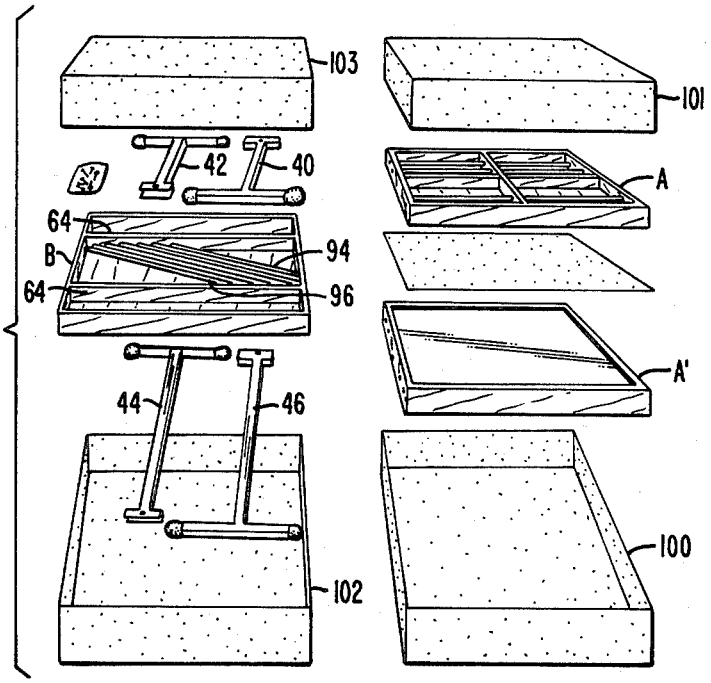
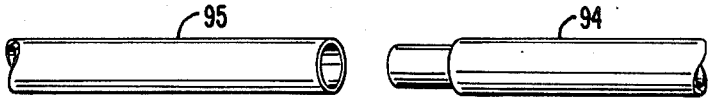
FIG._6A.
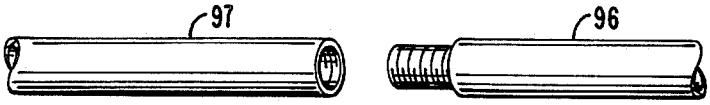
FIG._6B.

ADJUSTABLE MULTI-LEAF TABLE

BACKGROUND OF THE INVENTION

This invention relates to tables and discloses a three sectioned work table which can be mounted to varying heights and angles.

DESCRIPTION OF THE RELEVANT LITERATURE

Variable length tables are known. Typically, sets of telescoping runners mount fixed leaves for movement towards and away from one another. By capturing leaves in between the fixed runners, the tables extend to varying lengths.

Unfortunately, such telescoping mechanisms are not suitable for work tables. Typically the side-by-side leaves form discontinuities which are unacceptable for work surfaces. Moreover, such tables lack sturdiness and commonly are without durability of finish for work surfaces.

Solid tables sufficient to form large working surfaces are seldom found. For the average homeowner they occupy too much room to be left standing at all times. Activities such as home sewing require large work surfaces. Users heretofore have been forced to rely on floors, beds and other unsuitable locations. There is a real need for a home work table which can be assembled and disassembled for activities, especially sewing.

Adjustable cross leg tables are known. See Wilkins U.S. Pat. No. 827,940; McKenny U.S. Pat. No. 1,975,857; Jerick U.S. Pat. No. 2,581,023.

SUMMARY OF THE INVENTION

A work table is disclosed having three end-to-end abutted sections joined by adjustable longitudinal bars for forming a rigid table from one or more of the respective sections. Four sets of adjustable bars extend longitudinally of the table and fit varying lengths of the table comprising from 1 to 3 sections of the abutted table members. The bars extend in parallel to the longitudinal length of the table, provide rigidity to the respective table sections as well as extend between the respective sections when one or more leaves are joined. Cross X-type legs are provided with a variable pivot. The variable pivots enables the crossover point of the legs to be varied so that the table may be disposed at various heights and inclinations about its longitudinal length. The legs are provided at their upper end with U-sectioned channels having locking wing nuts for keying at selected locations to the longitudinal bars. The legs at their lower end include parallel extending shoe members to impart a longitudinal rigidity as well as a side-by-side rigidity to the supported work surface of the table. The table when disassembled provides for convenient storage and shipment in a small contained package. Provision is made for the mounting of a quilting rack.

An object of this invention is to disclose a variable length table with rigid interconnecting leaves. A plurality of leaves, preferably two end leaves and a medial leaf are utilized, each leaf being formed from a membrane with a hard working surface on one side. These leaves are reinforced with peripheral and medial gussets to maintain the working surface flat. The leaves register at their gussets. The gussets are transpierced with and registered by aligned apertures. The apertures snugly receive piping to fasten the leaves to one another. The piping rigidly registers the table sections to one another.

An advantage of the piping combined with the table sections is that each working table surface is held and maintained absolutely flat.

A further advantage of the piping is that adjoined table sections are maintained in precise registry with one another.

A further object of this invention is to disclose a table leg system. In accordance with this aspect of the invention, each table leg is provided with a U-sectioned channel at the upper end, a parallel extending leg shoe at the lower end and a leg column extending therebetween. Pairs of legs are utilized for the support of each end of the table. The legs are pivoted about their central portion to provide an "X" cross-bracing configuration. Each leg fastens to the table bars at the upwardly exposed U-shaped sections. Typically, a wing nut wedges the bars securely to the U-shaped channel.

An advantage of this aspect of the invention is that the pivot point can be changed as desired between the legs. Changes can be made to change the angle of the mounted table as well as the height of the table.

An important aspect of this table is that it can be completely disassembled. When disassembled, it fits within a small packing space so that shipment or storage is easily accommodated.

BRIEF DESCRIPTION OF THE DRAWINGS

Other objects, features and advantages of this invention will be more apparent after referring to the following specification and attached drawings in which:

FIG. 4 illustrates the table in a three-leaf embodiment;

FIG. 5 illustrates the table collapsed in an exploded disposition packaged as for storage or shipment;

FIG. 6A illustrates a bayonet fitting of one of the pipes;

FIG. 6B illustrates a threaded fitting for others of the pipes;

DESCRIPTION OF THE PREFERRED EMBODIMENTS

Figure 1:
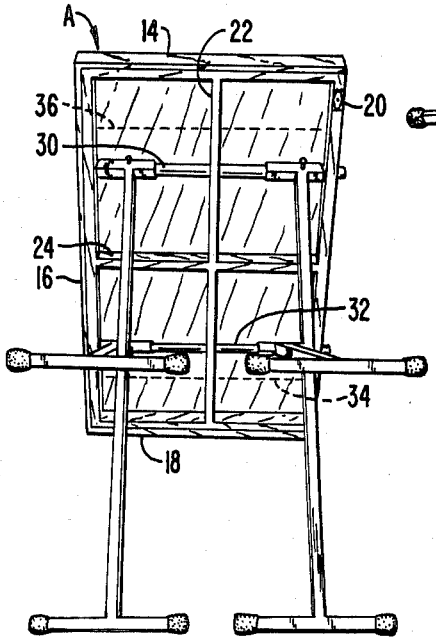
FIG. 1 is a perspective view from underneath a table illustratng a single leaf with inserted bars having the legs of this invention securely attached thereto.

Referring to FIG. 1, the table of this invention is shown having a single end section A. The end section is provided with surrounding and reinforcing frame stock 14, 16, 18. This frame stock reinforces a plywood panel or wood membrane having a veneered surface coated with a protective plastic coating.

The plywood is in turn provided with transverse gussets 20, 22 and a single end gusset 24.

Gussets 20, 22 and end frame 16 are fitted with apertures. These apertures permit pipes 30, 32 to be snugly fitted therethrough. In the embodiment shown in FIG. 1, only one pair of pipes 30, 32 are threaded therethrough. Shown in phantom (broken lines) are second slots 34, 36. These slots enable piping to be inserted along alternate parallel paths.

Figure 2:
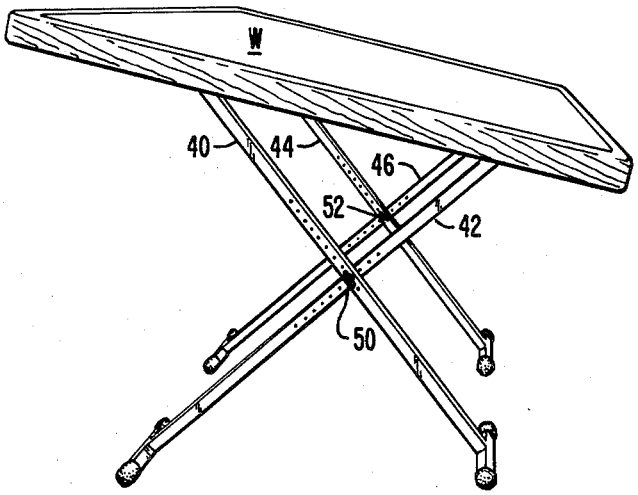
FIG. 2 is a side elevation perspective of the table illustrating the work surface mounted at an angle.

Referring to FIG. 2 a side elevation perspective is illustrated of the table. The work surface W is shown. Paired crossed leg members 40, 42 support one table end and paired cross leg members 44, 46 support the opposite table end.

Figure 7:
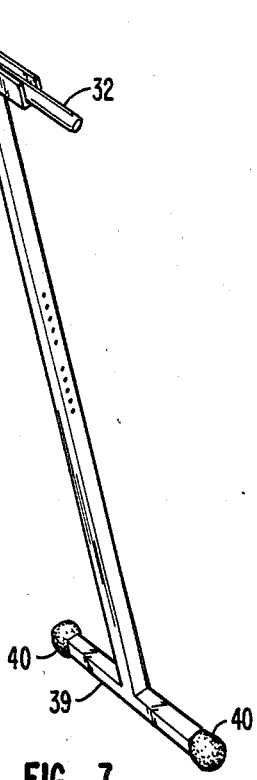
FIG. 7 illtrates a U-shaped channel for capturing the disclosed pipes.

Stopping here and referring to FIG. 7, operations of the legs can be understood. Specifically, each leg member includes a square bar section. This bar section fastens to one of the pipes as the upper end. The leg rests on the floor at the lower end. Two of the legs pivotally connect to form a leg pair for support of a table end.

Regarding fastening to the pipe at the upper end, a pipe 32 is shown placed with an outwardly exposed U-sectioned channel 34. Channel 34 is in turn fastened to a leg member 36 as by welding.

U-shaped channel member 34 is dimensioned to snugly receive piping 32 therein. Typically, a wing nut 37 threaded to a sidewall of the U-shaped channel, transpierces the U-section, bears against the pipe 32 and traps the pipe with respect to the U-sectioned channel.

It is noted that the U-sectioned channel is given a discrete length in the order of 6-inches. This length enables the channel to be held snugly to the pipe 32 without having a rocking motion relative thereto.

At the oposite end of the leg 36 there is provided a footbar 39. Bar 39 has respective rubber stops 40 at the opposite ends thereof. As can be seen in the view of FIG. 7, footbar 39 extends parallel to channel 34. This parallel extension assures that the bar rests securely on the floor at all angles of the legs with respect to the table W and any flat surface on which the table is supported.

Returning to FIGS. 1 and 2, mounting of the work surface W with respect to the table, can easily be understood. Specifically, it will be seen that each of the leg pairs 40, 42 and 44, 46 are fastened to one another by respective bolts 50, 52. These respective bolts 50, 52 transpierce a series of apertures in each of the cross legs. For example, they can transpierce the apertures so that the work surface W is mounted at an angle with respect to the floor or ground upon which the table is mounted.

It will be understood that the mounting of the table is surprisingly rigid. The table will not move with respect to the plane of the crossed legs as the crossed legs provide well known structural rigidity.

Additionally, the table will not move with ease in the direction of the pipes 30, 32. The U-shaped channel 34 and the legs 36 with the extending footbar 39 likewise prevent such movement.

Having set forth the operative mechanics of the mounting of a single leaf, the mounting of a double leaf table can now be understood.

Figure 3:
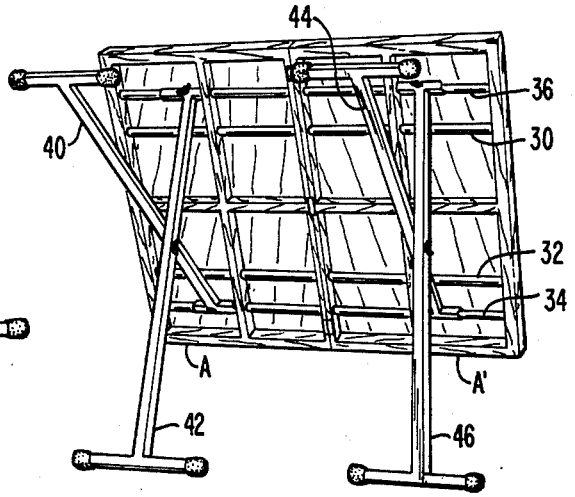
FIG. 3 illustrates the table in a two-leaf embodiment.

Referring to FIG. 3, the table is illustrated from the underside having two end leaves A and A′ forming a continuous working surface. It will be seen that piping 30, 32, 34, and 36 extends joining the two sections A, A′.

The legs 40, 42 and 44, 46 are shown each supporting on of the respective end sections A, A′.

Joining of the pipe sections can be easily understood. Specifically, male members 94, 96 either bayonet or thread in to complementary female members 95, 97.

It is at this point that the reader will understand that the piping forms at the junction of the two tables an usually strong, solid connection. Moreover, the working surface W of each of the panels is constrained to the same elevation. This being the case, a smooth and mating engagement between the working surfaces of the table is formed.

Referring to FIG. 4, the table is shown in an embodiment wherein three sections A, A′ and B are mounted together.

Section B is essentially a derivative of either sections A or A′ with the end framing member 16 omitted. Medial member B includes paired gussets 60, 62 at each end and two medial gusset 64 therebetween. Similar to the gussets 22 and 20, gussets 60, 62 are transpierced to allow piping 30, 32, 34, 36 to extend lengthwise of the table.

Regarding the two medial gussets 64, these gussets are given a dimension to enable reinforcing piping 30, 32, 34, 36 to fit in a disassembled configuration within the volume defined by the table top and gussets. Thus, either shipping or storage enables the pipe sections to be essentially contained within the table top.

The respective legs 40, 42 and 44, 46 are fastened at the respective end sections A, A′. Fastening is here shown to bars 30, 32. Fastening of the legs could as well be to bar sections 34, 36.

Again in the embodiment of FIG. 4, the rigidity of the table is assured. By the use of the combination of four bars, transpiercing four defined pipeways across the respective gussets, absolute rigidity of the table is assured. Mounting of the legs at the bars forms a table of surprising rigidity. For example, the table shown in FIG. 4 can support the weight of a grown man (about 200 lbs.) without appreciable movement.

It is emphasized that the table comprises when assembled a large work surface. Specifically, it is approximately 6-feet in length, 4-feet in width and capable of supporting at least 200 lbs.

This table finds a special use in the home sewing market. Specifically, it has been found that in the cutting of garments, there is a need for a work surface that is approximately the size of a person stretched vertically on the work surface. The disclosed table not only meets this requirement but is capable of disposing the work surface at a convenient angle (see FIG. 2) so that working may conveniently occur from one side of the table.

With respect to FIG. 5, disassembly and packing of the table can be understood. Typically, one of the end sections A, A′ is provided with four bar sections inserted therein. These bar sections are the short female bar sections shown in FIG. 6A and FIG. 6B.

Typically, the two sections are then confronted at their work surfaces, and packed together, preferably with suitable cardboard protective interfacing between the work surfaces. These two end sections with enclosed bars are captured between box sections 100, 101.

The medial section B provides a slightly differing case. Specifically, gussets 64 define a volume into which the male pipe sections 94, 96 can fit. Overlying and underlying the table section B there are placed legs 40, 42, 44 and 46 in a disassembled disposition. Again suitable cardboard packaging material is provided to prevent damage in shipment within box sections 102, 103. Naturally, the illustrated disposition for shipment can likewise be utilized for storage in the home.

Figure 8:
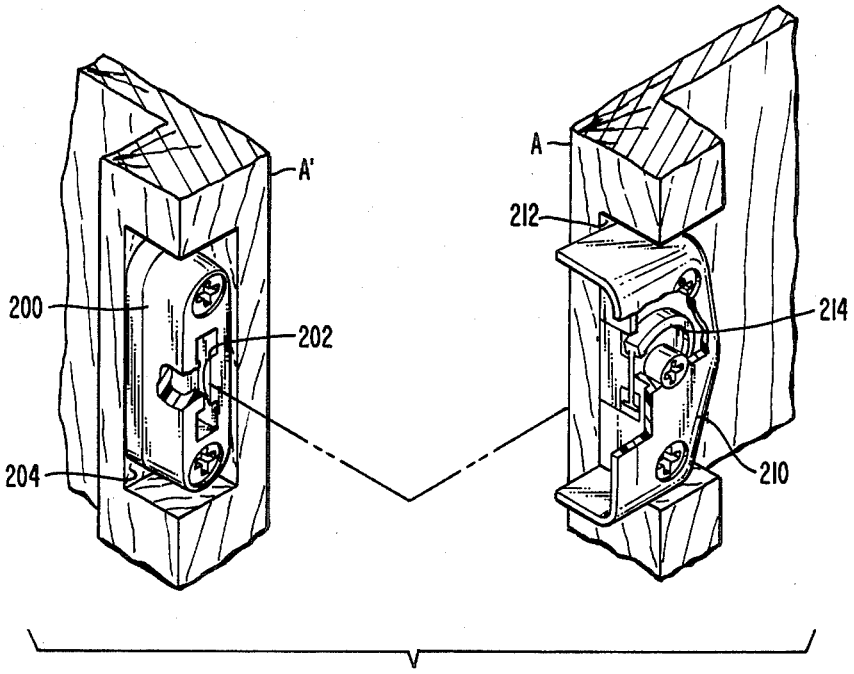
FIG. 8 is a detail of a clamp that is preferably used to draw adjacent side edges of the table together, the clamp being shown before opening; and, FIG. 9 is a detail of the same clamp when closed and holding adjacent sections of the table together.
Figure 9:
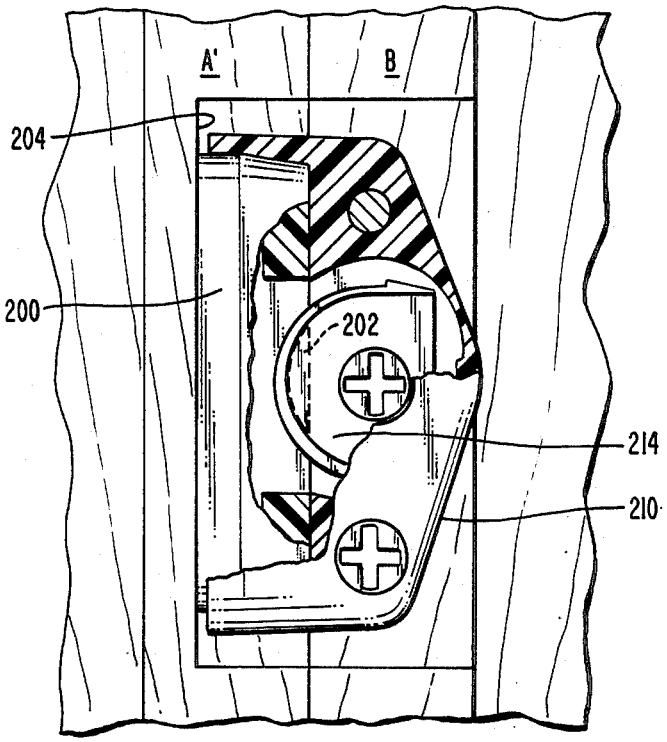

It is preferred that the adjacent table leaves A, A′, and B be held firmly together by clamps. Such a clamp is illustrated in FIG. 8 and 9.

Specifically, a female clamp member 200 is provided with a semicircular raceway 202. The female clamp member is held within a recess in the panel side wall 204.

Similarly, and mounted in a complimentary position, male clamp member 210 is held within a recess 212 in the panel side. This member has a rotating male fitting 214 which engages female raceway 202. When two panels are tightly registered together, and the clamps locked as illustrated at FIG. 9, firm side-by-side engagement of the table leaves occurs.

I prefer to use two such clamps on adjacent leaves. Moreover, by the expedient of using clamps on all three panels at the same location I can rely on clamp end leaves A, A′ together in combination as well as leaves A, B, A′ together. The leaves A′, A are shown in FIG. 8; the leaves A′, B are shown in FIG. 9.

The reader will realize that the clamp herein illustrated is preferred. Other clamps will work as well. All that is required is that there be a firm side-by-side engagement of the working surfaces.

What is claimed is:

1. An adjustable table comprising in combination;

first and second table leaf members, each said table leaf member including:

a membrane having a flat working surface;

a plurality of transverse and a plurality of longitudinal gussets attached to the back side of said membrane to form reinforcement for said membrane whereby said membrane is stiffened into a table leaf member having an upwardly disposed working surface;

a plurality of pipes for supporting said table leaf members at said gussets and extending between said gussets to join said table leaf members into a unitary upwardly disposed table;

said plurality of transverse gussets defining respective aligned circular holes for snugly receiving and surrounding said pipes between said plurality of transverse gussets with said table leaf members registered one to another whereby said pipes are fastened to said table leaf members and cause said table leaf members to be fastened and registered one to another;

locking means extending between said table leaf members for drawing said table leaf members over said pipes into snug side-by-side engagement at adjacent edges of said leaf members;

two pairs of legs members, each said pair of leg members including;

first and second leg members with each leg member having an elongate longitudinal member having an upper end and a lower end;

a member for fastening each said leg to said pipes including a normal affixed U-sectioned channel member at the upper end of each of said leg member;

a normally affixed shoe member affixed to the lower end of said leg member parallel to said U-sectioned channel member, said shoe member extending beyond said leg to transversely support said leg at least one side thereof;

said U-sectioned channel member dimensioned to received said table leaf member at one of said pipes;

means for clamping said pipes to said U-sectioned channel members and;

means for pivotally mounting said leg pairs together whereby said pairs of leg members pivotally and rigidly support said table in a cross-based disposition.

2. The invention of claim 1 and wherein said clamping means includes a wing nut threaded to said a side of said U-sectioned member wedging said pipe in said U-sectioned members.

3. The invention of claim 1 and wherein said table includes three leaf members.

4. The invention of claim 1 and wherein said legs can be pivotally joined at variant locations thereon.

* * * * *